US007412176B2

(12) United States Patent
Park

(10) Patent No.: US 7,412,176 B2
(45) Date of Patent: Aug. 12, 2008

(54) METHOD OF PROCESSING AN ERROR OF AN IMAGE FORMING APPARATUS

(75) Inventor: Sung-keun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 722 days.

(21) Appl. No.: 10/920,183

(22) Filed: Aug. 18, 2004

(65) Prior Publication Data

US 2005/0111860 A1 May 26, 2005

(30) Foreign Application Priority Data

Nov. 26, 2003 (KR) ..... 10-2003-0084404

(51) Int. Cl.
*G03G 15/00* (2006.01)
*G03G 15/16* (2006.01)

(52) U.S. Cl. ..... 399/18; 399/21; 399/101

(58) Field of Classification Search ..... 399/18, 399/21, 71, 101, 343
See application file for complete search history.

(56) References Cited

U.S. PATENT DOCUMENTS 5,506,669 A * 4/1996 Inoue et al. ..... 399/71
5,729,788 A * 3/1998 Hirohashi et al. ..... 399/101 X
5,815,766 A * 9/1998 Miller et al. ..... 399/21
6,311,031 B1 * 10/2001 Hirano ..... 399/101
6,321,059 B1 * 11/2001 Tamura ..... 399/18 X
6,603,932 B2 * 8/2003 Katayanagi et al. ..... 399/21

FOREIGN PATENT DOCUMENTS

| | | |
|---|---|---|
| JP | 58-211777 | 12/1983 |
| JP | 06-019369 | 1/1994 |
| JP | 09-006146 | 1/1997 |
| JP | 2001-201954 | 7/2001 |
| JP | 2002-174967 | 6/2002 |

* cited by examiner

*Primary Examiner*—Sandra L Brase
(74) *Attorney, Agent, or Firm*—Stanzione & Kim, LLP

(57) ABSTRACT

A method of processing an error of an image forming apparatus judges an error occurrence of the image forming apparatus, and if the error occurs, it stops the operation of a conveyer unit. After the operation of the conveyer unit is stopped, the method cleans an image forming unit, and then displays the error occurrence. Thus, the remaining toner on a transfer medium can be removed in advance when the error occurs, and the quality of an image can be secured.

20 Claims, 3 Drawing Sheets

METHOD OF PROCESSING AN ERROR OF AN IMAGE FORMING APPARATUS

CROSS-REFERENCE TO RELATED APPLICATIONS

This application claims benefit under 35 U.S.C. § 119 from Korean Patent Application No. 2003-84404, filed on Nov. 26, 2003, the disclosure of which is incorporated herein in its entirety.

BACKGROUND OF THE INVENTION

1. Field of the Invention

The present invention relates to a method of processing an error of an image forming apparatus, and more particularly, to a method of processing an error of an image forming apparatus that first cleans a transfer medium of the image forming apparatus and then displays an error when the error occurs.

2. Description of the Related Art

In general, image-forming apparatuses such as laser printers, duplicators, and so on are provided with a conveyer unit for conveying a printing paper in the image forming apparatus, and an image forming unit for forming an image on the paper. The conveyer unit includes a feeder unit for feeding the paper to the image forming apparatus and a delivery unit for delivering the paper on which an image is formed outside the image forming apparatus.

The image forming unit includes a photosensitive unit having a photosensitive drum for forming the image and a transfer unit for transferring the image formed by the photosensitive unit to the paper.

The image-forming apparatus as constructed above prints a desired image on the paper through successive processes of charge distribution, exposure, development, transfer, fusing, and so on.

However, while the image is printed on the paper through the above-described processes, errors such as malfunction of the image forming apparatus and so on may occur in the image forming apparatus.

FIG. 1 is a flowchart illustrating a conventional method of processing an error of an image forming apparatus.

Referring to FIG. 1, the image forming apparatus performs a printing operation on the paper through interactions of various kinds of devices provided inside the image forming apparatus (S10).

During the printing operation, a control unit provided in the image forming apparatus detects the occurrence of an error through an error sensor (S11). If no error occurs, the image forming apparatus continues the printing operation (S12), while if an error occurs, the control unit displays an error signal through an error display device provided in one side of the image forming apparatus (S13).

For instance, the error may be a paper jam that occurs in the paper conveyer unit, or any malfunction of the devices provided inside the image forming apparatus. Generally, the error signal may be displayed through a liquid crystal display, or may be provided as an alarm signal for a predetermined time period.

Then, the control unit stops the operations of the feeder unit, the delivery unit, the photosensitive unit and the transfer unit provided in the image forming apparatus (S15).

In the image forming apparatus, a transfer from the photosensitive unit to the transfer unit is first performed, and then a transfer from the transfer unit to the paper is performed. If the operations of the feeder unit, the delivery unit, the photosensitive unit and the transfer unit are simultaneously stopped during the printing operation, the toner, which has not yet been transferred to a printing paper, may remain on a transfer medium or a transfer belt provided in the transfer unit.

Thereafter, if the cause of the error occurrence is removed and the image forming apparatus re-operates, the transfer is performed in a state that the toner remaining on the transfer belt is not completely removed, and thus the quality of the image to be printed on the paper deteriorates. Especially, in the case that the error is the paper jam, the transfer unit itself should be separated from the image forming apparatus, and thus the toner remaining on the transfer belt may be scattered in the image forming apparatus, thereby causing the contamination of the image forming apparatus.

If the cause of the error occurrence cannot be removed for a long time, the toner also remains on the transfer belt of the transfer unit for a long time, and this causes the lifespan of the transfer belt and the transfer efficiency to be reduced.

Also, if the error occurs in the image forming apparatus, the error signal is first displayed, and then the operation of the image forming apparatus is stopped. During this error processing time, a user may open a main cover of the image forming apparatus, and this causes the user to be exposed to the operation of various kinds of devices in the image forming apparatus, thereby threatening the user's security.

SUMMARY OF THE INVENTION

The present invention has been developed in order to solve the above drawbacks and/or other problems associated with the conventional arrangement. An aspect of the present general inventive concept is to provide an improved method of processing an error of an image forming apparatus that processes the error in a manner that measures are first taken and then a report follows the measures.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are substantially realized by providing a method of processing an error of an image forming apparatus provided with a conveyer unit that conveys a printing paper in the image forming apparatus and an image forming unit that forms an image on the paper, of the method including judging whether an error occurs, stopping an operation of the conveyer unit if the error occurs, cleaning the image forming unit after the operation of the conveyer unit is stopped, and displaying the error occurrence after the image forming unit is cleaned.

The conveyer unit may include a feeder unit that feeds the paper to the image forming apparatus and a delivery unit that delivers the paper on which an image is formed outside the image forming apparatus.

The operation of stopping the conveyer unit may include stopping an operation of a delivery unit that delivers the paper on which an image is formed outside the image forming apparatus, separating a transfer roller that is in contact with the image forming unit from the image forming unit, and stopping an operation of a feeder unit that feeds the paper to the image forming apparatus.

The separating operation may be performed after the operation of the delivery unit is stopped and before the operation of the feeder unit is stopped.

The image forming unit may include at least one photosensitive unit having a photosensitive drum to form the image and a transfer unit having a transfer medium that transfers the image formed by the photosensitive unit to the paper.

The cleaning operation may include driving the transfer medium and the photosensitive drum, removing the remaining toner of the transfer medium by bring a cleaning blade into contact with the transfer medium, and may further include judging whether the transfer medium is driven for a predetermined distance, and if the transfer medium is driven for the predetermined distance, stopping the operations of the photosensitive unit and the transfer medium.

The judging operation may judge whether the transfer medium is driven to make at least one revolution, and may compare a time for which the transfer medium is driven after the error occurrence with a reference time required for the transfer medium to make one revolution.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
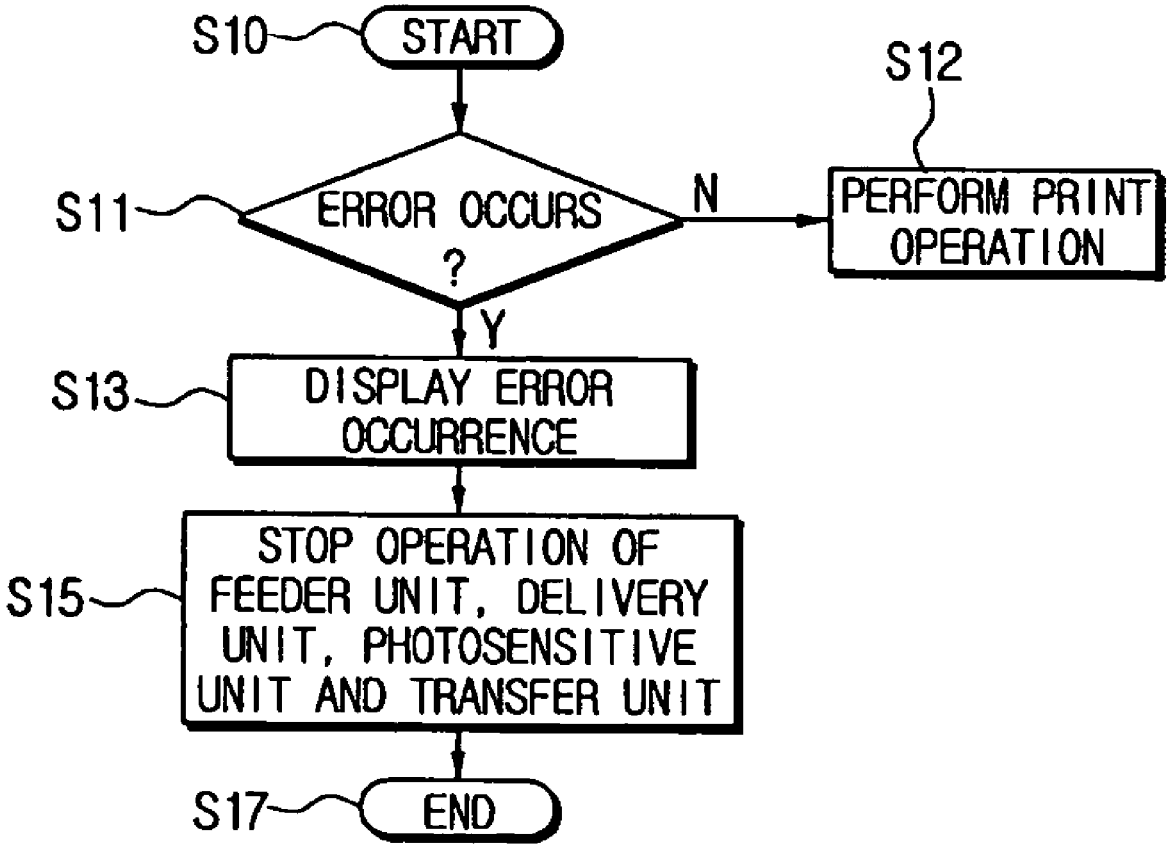
FIG. 1 (PRIOR ART)
FIG. 1 is a flowchart illustrating a conventional method of processing an error of an image forming apparatus.

Certain embodiments of the present invention will be described in greater detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the present general inventive concept. Thus, it is apparent that the present general inventive concept can be carried out without those defined matters. Also, well-known functions or constructions are not described in detail since they would obscure the present general inventive concept in unnecessary detail.

Figure 2:
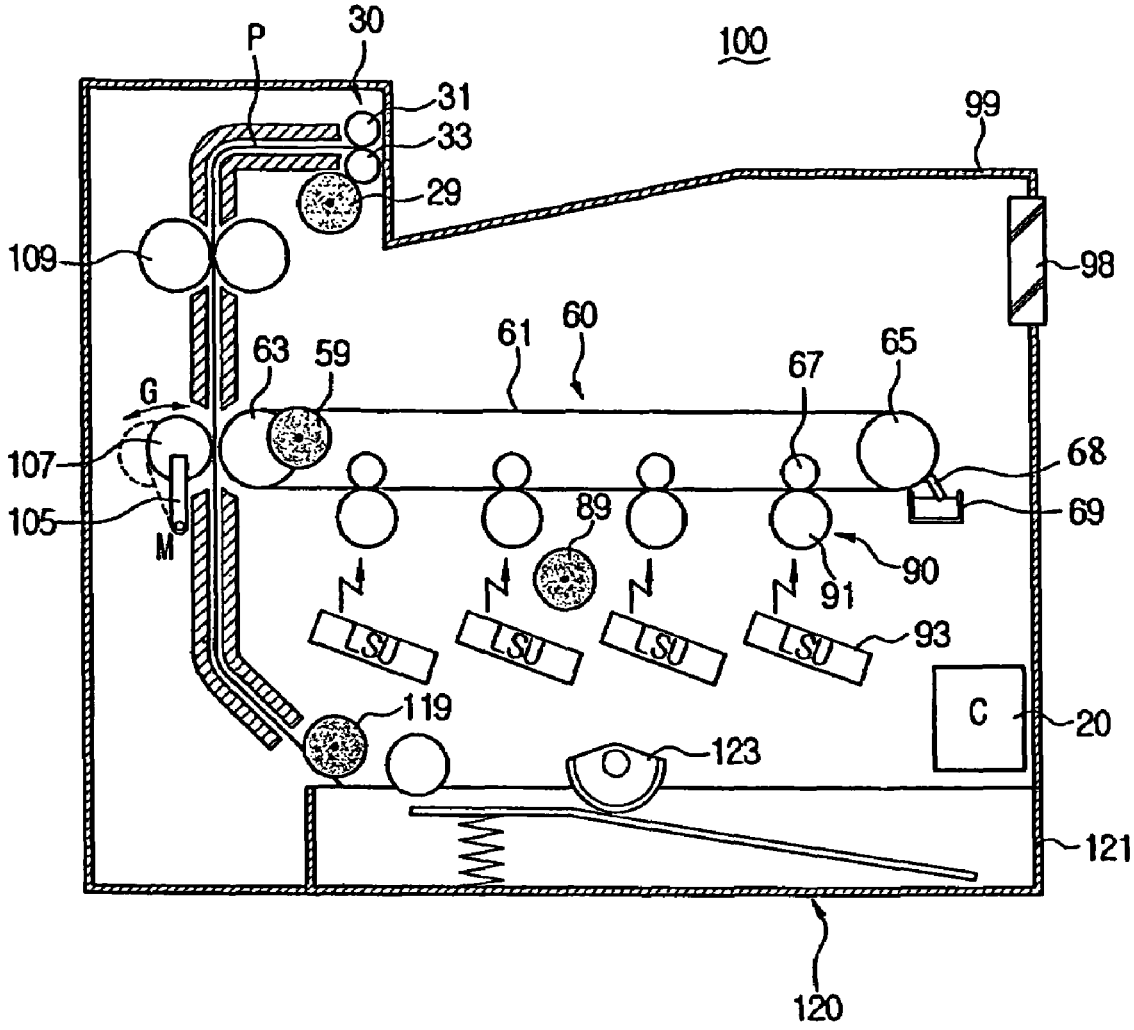
FIG. 2 is a schematic view illustrating the construction of an image forming apparatus that adopts an error processing method according to an embodiment of the present invention.

FIG. 2 is a schematic view illustrating the construction of an image forming apparatus that adopts an error processing method according to an embodiment of the present general inventive concept.

Referring to FIG. 2, the image forming apparatus 100 is provided with a conveyer unit that conveys a printing paper in the image forming apparatus, an image forming unit that forms an image on the paper, and a control unit 20.

The conveyer unit may include a feeder unit 120 that feeds the paper to the image forming apparatus 100 and a delivery unit 30 that delivers the paper on which an image is formed outside the image forming apparatus 100.

The feeder unit 120 may include a feeder tray 121 having a recess that receives the papers, and a pickup unit 123 that picks up and forwards the paper in the feeder tray 121 to a main body 99.

The delivery unit 30 may include a delivery roller 33 that delivers the paper conveyed through a conveyer path P outside the image forming apparatus, and a backup roller 31 that engages with the delivery roller 33.

The image forming unit may include a plurality of photosensitive units 90 and transfer units 60. The respective photosensitive unit 90 may include a photosensitive drum 91 that forms the image and a plurality of laser scanning units (LSUs) that scan a laser beam, which is modulated according to electric data of a part on which the image is formed, onto the photosensitive drum 91.

The transfer unit 60 may include a transfer medium 61 that moves along an endless track and transfers the image formed by the photosensitive unit 90 to the paper, and a plurality of rollers supportably installed inside the transfer medium 61.

The transfer medium 61 may include a transfer belt, and the plurality of rollers may include a driving roller 63, a cleaning backup roller 65, and a plurality of rollers 67 that transfer the image formed by the photosensitive drum 91 in correspondence to the photosensitive drums 91.

At one side of the transfer medium 61, a cleaning blade 68 that removes the toner that remains on the transfer medium 61 is installed in correspondence to the cleaning backup roller 65, and a waste bin 69 that stores the remaining toner may be connected to the cleaning blade 68.

Also, in a part corresponding to the driving roller 63 of the transfer medium 61, a transfer roller 107 that transfers the image on the transfer medium 61 to the paper may be provided, and the transfer roller 107 is in contact with the transfer medium 61. Also, the transfer roller 107 may be connected to a movable means having a rotating member 105, and is brought into contact with or separates from the transfer medium 61 in a direction indicated as an arrow "G" centering around a reference point "M" in FIG. 2. The movable means of the transfer roller 107 may have diverse constructions.

The control unit 20 may be provided in the main body 99 of the image forming apparatus as illustrated, and controls the printing operation of the image forming apparatus 100 by controlling the image forming unit and the conveyer unit provided inside the main body 99 based on the input image information or pint data.

Meanwhile, the delivery unit 30, the transfer unit 60, the photosensitive unit 90, and the feeder unit 120 have driving sources 29, 59, 89 and 119, respectively, and such driving sources 29, 59, 89 and 119 provide driving forces to the units 30, 60, 90 and 120, respectively, under the control of the control unit 20. The driving sources 29, 59, 89 and 119 may include motors, respectively, or a single driving source may transmit its driving force to the respective units 30, 60, 90 and 120 via a train of gearing or a timing belt as needed.

The printing operation performed by the image forming apparatus is explained below.

If image information or print data is input to the image forming apparatus 100, the control unit 20 detects the image information or print data and forms a latent image onto the photosensitive drum 91 by operating the laser scanning units 93 according to the electric data of the image, and the photosensitive drum 91 forms the image according to the scanned beam, and transfers the image to the transfer medium 61.

The image formed on the transfer medium 61 is retransferred to the supplied paper through the transfer roller 107. The image formed on the paper is fused on the paper with a high temperature and a high pressure through a fuser roller 109, and then the paper on which the image is fused is delivered outside the image forming apparatus 100 through a delivery unit 30.

Hereinafter, a method of processing an error that is generated during the printing operation will be explained.

Figure 3:
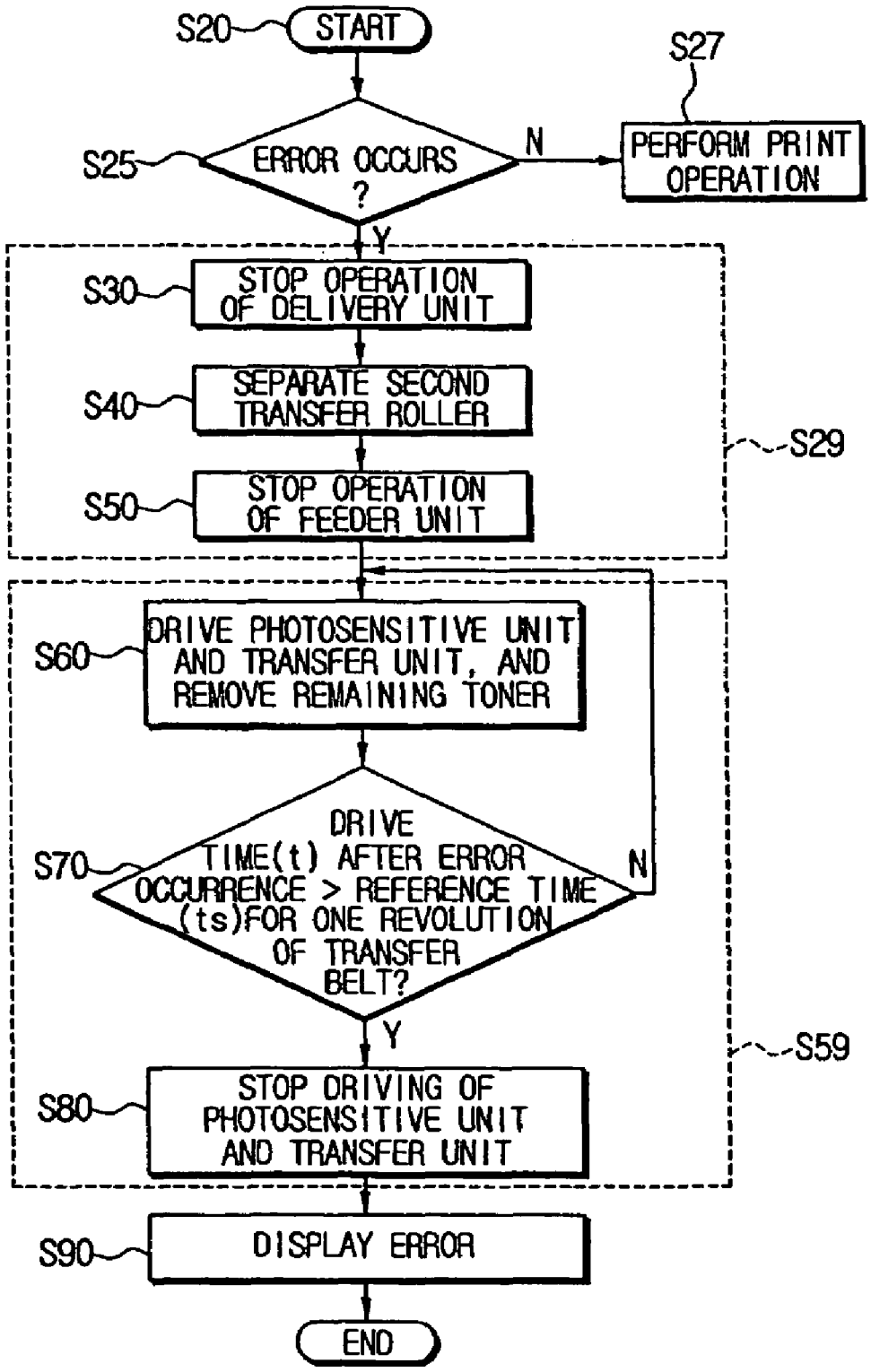
FIG. 3 is a flowchart illustrating a method of processing an error of an image forming apparatus as illustrated in FIG. 2.

FIG. 3 is a flowchart illustrating a method of processing an error of an image forming apparatus as illustrated in FIG. 2.

Referring to FIGS. 2 and 3, the image forming apparatus 100 performs the printing operation on the paper through interactions of various kinds of devices provided inside the image forming apparatus (S20).

During the printing operation, the control unit 20 provided in the image forming apparatus 100 detects the occurrence of an error through an error sensor (not illustrated) (S25). Generally, the error may be a paper jam that occurs in the paper conveyer unit, or any malfunction of the devices provided inside the image forming apparatus. If no error occurs, the image forming apparatus 100 continues the printing operation according to an input command (S27), while if an error occurs, it stops the operation of the conveyer unit (S29).

If the operation of the conveyer unit is stopped, the control unit stops the operation of the delivery unit 30 that delivers the paper on which the image is formed outside the image forming apparatus, and thus the delivery of the paper through the delivery unit is stopped (S30).

Then, the control unit 20 separates the transfer roller 107 that is in contact with the transfer unit 60 of the image forming unit from the transfer unit 60 (S40). Accordingly, the transfer of the image formed on the transfer medium 61 of the transfer unit 60 to the paper is prevented.

If the transfer is stopped, the operation of the feeder unit 120 that supplies the paper to the image forming apparatus 100 is stopped, and this causes the supply of a new paper to the image forming apparatus 100 to be stopped (S50). The separating operation S40 may be performed after the operation of the delivery unit 30 is stopped (S30), but before the operation of the feeder unit 120 is stopped (S50).

In the state that a series of operations of the conveyer unit are stopped, the toner, which has not yet been transferred to the paper, remains on the transfer medium 61. Accordingly, a cleaning operation to remove the toner remaining on the transfer medium 61 is then performed. The cleaning operation may also be performed simultaneously with the separating operation S40 of the transfer roller 107.

At the cleaning operation, the photosensitive unit 90 and the transfer unit 60 are continuously driven even after the occurrence of the error (S60). Also, as needed, the photosensitive unit 90 and the transfer unit 60 may be controlled in such a manner that under the control of the control unit 20, they are temporarily stopped after the occurrence of the error, and then re-driven.

During the driving of the photosensitive unit 90 and the transfer unit 60, the remaining toner on the transfer medium 61 is removed by the cleaning blade 68 that is in contact with the transfer medium 61, and then is collected in a waste bin 69.

At this time, the control unit 20 judges whether the transfer medium 61 of the transfer unit 60 is driven to make at least one revolution in order to remove the remaining toner on the transfer medium 61 since the transfer medium 61 should be driven over a predetermined distance (S70).

Accordingly, after the occurrence of the error in the image forming apparatus, the driving time 't' of the transfer unit 60 and the photosensitive unit 90 is measured, and then compared with a reference time 'ts' required for the transfer medium 61 to make one revolution.

If the driving time 't' is longer than the reference time 'ts', the operations of the photosensitive unit 90 and the transfer unit 60 are stopped (S80). At this time, since the transfer medium 61 makes at least one revolution, the remaining toner on the transfer medium 61 can be removed. This reference time 'ts' may be set to a time required for the transfer medium 61 to make plural revolutions, for instance, at least two revolutions.

Then, the control unit 20 displays an error signal through an error display device provided on one side of the image forming apparatus 100 (S90). Generally, the error signal may be displayed through a liquid crystal display, and an alarm signal may be produced for a predetermined time.

At this time, the error may be a paper jam that occurs in the paper conveyer unit, or any malfunction of the devices provided inside the image forming apparatus. The error signal may be displayed through a liquid crystal display, or may be alarmed as an alarm signal for a predetermined time period.

According to the error processing method of the image forming apparatus 100, the remaining toner on the transfer medium 61 provided in the transfer unit 60, which has not yet been transferred to the paper, is removed, and then the operations of the photosensitive unit 90 and the transfer unit 60 are stopped. Thereafter, the error message is displayed through an error display device 98.

Accordingly, the error of the image forming apparatus is processed in a manner in which measures are first taken and then a report follows up the measures, and thus the user's security can be guaranteed even if the user impatiently opens a main cover (not illustrated) of the image forming apparatus 100.

Also, since the remaining toner on the transfer medium 61 is removed in advance when an error occurs, the deterioration of the quality of the image to be printed on the paper can be prevented.

Especially, in the case that the error is the paper jam, the transfer unit 60 itself should be separated from the image forming apparatus 100, and in this case, the contamination of the image forming apparatus 100 due to the scattering of the toner remaining in the transfer medium 61 can be prevented.

As described above, according to the embodiment of the present general inventive concept, the toner remaining on the transfer medium can be removed in advance when an error occurs, and thus the image quality can be secured. Also, when the transfer unit is separated from the image forming apparatus, the scattering of the remaining toner in the image forming apparatus can be prevented and the contamination of the image forming apparatus can be reduced.

The foregoing embodiments and advantages are merely exemplary and are not to be construed as limiting the general inventive concept. The present teaching can be readily applied to other types of apparatuses. Also, the description of the embodiments of the general inventive concept is intended to be illustrative, and not to limit the scope of the claims, and many alternatives, modifications, and variations will be apparent to those skilled in the art.

What is claimed is:

1. A method of processing an error of an image forming apparatus provided with a conveyer unit to convey a printing paper in the image forming apparatus and an image forming unit to form an image on the paper, the method comprising:

judging whether an error of the image forming apparatus occurs;

stopping an operation of the conveyer unit if the error occurs;

cleaning the image forming unit after the operation of the conveyer unit is stopped; and displaying the error occurrence after the image forming unit is cleaned.

2. The method of claim 1, wherein the conveyer unit comprises:

a feeder unit to feed the paper to the image forming apparatus; and a delivery unit to deliver the paper on which an image is formed outside the image forming apparatus.

3. The method of claim 1, wherein the operation of stopping the conveyer unit comprises:

stopping an operation of a delivery unit delivering the paper on which an image is formed outside the image forming apparatus;

separating a transfer roller that is in contact with the image forming unit from the image forming unit; and stopping an operation of a feeder unit feeding the paper to the apparatus.

4. The method of claim 3, wherein the separating operation is performed after the operation of the delivery unit is stopped and before the operation of the feeder unit is stopped.

5. The method of claim 1, wherein the image forming unit comprises:

at least one photosensitive unit having a photosensitive drum to form the image; and a transfer unit having a transfer medium to transfer the image formed by the photosensitive unit to the paper.

6. The method as claimed in claim 5, wherein the cleaning operation comprises:

driving the transfer medium and the photosensitive drum; and removing remaining toner of the transfer medium by bring a cleaning blade into contact with the transfer medium.

7. The method as claimed in claim 6, wherein the cleaning operation further comprises:

judging whether the transfer medium is driven for a predetermined distance; and if the transfer medium is driven for the predetermined distance, stopping the operations of the photosensitive unit and the transfer medium.

8. The method as claimed in claim 7, wherein the judgment operation judges whether the transfer medium is driven to make at least one revolution.

9. The method as claimed in claim 8, wherein the judgment operation compares a time for which the transfer medium is driven after the error occurrence with a reference time required for the transfer medium to make one revolution.

10. A method of processing an error of an image forming apparatus having a transferring unit to form an image on a printing medium fed through a printing medium path, the method comprising:

determining when an error occurs during forming an image on the printing medium;

separating the transferring unit from the printing medium path and simultaneously cleaning the transferring unit if the determining operation has determined that the error has occurred; and providing a notifying signal if the determining operation has determined that the error has occurred.

11. The method of claim 10, further comprising:

stopping new printing mediums from being supplied to the image forming apparatus after the separating operation is performed if it has been determined that the error has occurred in the determining operation.

12. The method of claim 10, further comprising:

stopping delivery of an existing printing medium out of the image forming apparatus before the separating operation if it has been determined that the error has occurred in the determining operation.

13. The method of claim 10, wherein the notifying signal is a display signal that is sent to an error display device to display the error.

14. The method of claim 10, wherein the notifying signal is an alarm signal that is sent to an alarm device to signal the error.

15. The method of claim 10, further comprising restarting the image forming operation after the operation of cleaning the transferring unit has been performed.

16. A method of handling an error in an image forming apparatus, the method comprising:

determining whether an error has occurred in forming an image on a printing medium;

stopping the delivery of the printed medium out of the image forming apparatus if the determining operation has determined that the error has occurred;

separating a transferring unit from the printing medium path and simultaneously cleaning the transferring unit if the determining operation has determined that the error has occurred; and stopping new printing mediums from being supplied to the image forming apparatus after the separating operation is performed if the determining operation has determined that the error has occurred.

17. The method of claim 16, wherein the cleaning of the transferring unit is performed for a predetermined amount of time.

18. The method of claim 16, wherein the cleaning of the transferring unit is performed for a predetermined number of rotations of the transferring unit.

19. An image forming apparatus, comprising;

a photosensitive unit to form an image;

a transferring unit that transfers the image from the photosensitive unit to a printing medium;

a feeding unit that feeds the printing medium into the image forming apparatus along a printing medium path;

a delivery unit that delivers the printing medium out of the image forming apparatus after the image is transferred to the printing medium; and a control unit to determine whether an error has occurred during the image forming process, stop the delivery unit if it is determined that the error has occurred, separate the transferring unit from the printing medium path and simultaneously clean the transferring unit if it is determined that the error has occurred, and stop the feeding unit after the separating operation is performed if it is determined that the error has occurred.

20. The image forming apparatus of claim 19, wherein the control unit controls the cleaning of the transferring unit for a predetermined amount of time.

* * * * *